US006615455B1

(12) United States Patent
Pinto

(10) Patent No.: US 6,615,455 B1
(45) Date of Patent: Sep. 9, 2003

(54) FIBER OPENING APPARATUS

(76) Inventor: Akiva Pinto, Narciss Str. 9A-23, 92461 Jerusalem (IL)

( * ) Notice: Subject to any disclaimer, the term of this patent is extended or adjusted under 35 U.S.C. 154(b) by 0 days.

(21) Appl. No.: 10/244,185

(22) Filed: Sep. 16, 2002

(51) Int. Cl.[7] ..... D01G 15/40
(52) U.S. Cl. ..... 19/105; 19/200; 19/202
(58) Field of Search ..... 19/105, 106 R, 19/108, 107, 109, 200, 202, 203, 204, 205, 97.5, 65 A, 65 R, 145.5, 296, 303, 304

(56) References Cited

U.S. PATENT DOCUMENTS

| | | | | | |
|---|---|---|---|---|---|
| 3,829,934 | A | * | 8/1974 | Neu | 19/202 |
| 4,240,180 | A | * | 12/1980 | Wood et al. | 19/105 |
| 4,854,013 | A | * | 8/1989 | Pinto et al. | 19/200 |
| 4,858,278 | A | * | 8/1989 | Pinto et al. | 19/200 |
| 5,018,245 | A | * | 5/1991 | Marzoli et al. | 19/145.5 |
| 5,033,165 | A | * | 7/1991 | Temburg et al. | 19/107 |
| 5,303,455 | A | * | 4/1994 | Leifeld | 19/304 |
| 5,375,298 | A | | 12/1994 | Nakamura et al. | 19/296 |
| 5,522,119 | A | * | 6/1996 | Leifeld et al. | 19/106 R |
| 5,655,262 | A | * | 8/1997 | Sterin et al. | 19/200 |
| 6,138,326 | A | | 10/2000 | Pinto | 19/104 |
| 6,305,920 | B1 | | 10/2001 | Kean et al. | 425/83.1 |

OTHER PUBLICATIONS

Textile Machinery Research 1948–1978; Journal of Engineering for Industry; Feb. 1979, vol. 101.

* cited by examiner

*Primary Examiner*—Gary L. Welch
(74) *Attorney, Agent, or Firm*—McNair Law Firm, P.A.

(57) ABSTRACT

A fiber opening device comprising a feed section opening into the fiber opening section. The opening section includes a cabinet with an inner chamber, a waste removal chamber and a fiber web removal unit. The inner chamber includes a doffing roll and a contaminant collecting area located above first and second opening rolls. A main roll is located beneath and between the opening rolls and a waste removal section and a fiber web removal section are located beneath the main roll. In operation, fibers delivered into the inner chamber are first acted on by primarily one of the opening rolls which creates a tumbling action in which contaminants are dislodged and deposited into the contaminant receiving area while other fibers are picked up by the second opening roll carried to and doffed onto the main roll forming a fiber web for delivery to the fiber web removal section.

18 Claims, 3 Drawing Sheets

FIBER OPENING APPARATUS

BACKGROUND OF THE INVENTION

The present invention is directed to a fiber opening device or a fiber opening and cleaning device, which may be used in combination with fiber cleaning and fiber blending, machines.

Fiber opening as well as fiber opening and cleaning machines are well known in the textile industry. Universally, the opening rolls and main rolls are arranged in vertical stacks and the fibers are fed along substantially horizontal paths into these rolls.

The instant invention has as an object the utilization of gravity for delivering the fibers to and away from the opening rolls and the main roll.

Another object of the invention is the provision of a fiber opening or a fiber opening and cleaning device in which the rolls may be controlled to operate in the same or in opposed directions.

Another object of the invention is a fiber opening or a fiber opening and cleaning device in which mote knives are employed to assist in the fiber cleaning and blending.

Another object of the invention is a fiber opening or a fiber opening and cleaning device in which the machine may perform a normal operation, i.e. soft opening or an intensive opening operation.

Another object of the invention is an opening and cleaning device in which mote knives co-operate with both an opening roll and the main roll to dislodge waste and loose trash, to help open the fibers and to remove broken or fused fibers.

Another object of the invention is the provision of a fiber conditioning device which operates to open fibers to the stage of a single fiber.

SUMMARY OF THE INVENTION

The invention is directed to an opener for opening and cleaning fibers, which includes a feed section, and an opening station located beneath the feed section. The opening station includes a cabinet having an inner chamber, a waste removal chamber and a fiber web removal unit. The inner chamber contains on one side a doffing roll and on an opposed side a containment collecting area. First and second opening rolls are respectively arranged beneath the doffing roll and the containment area with a main roll located beneath and between the opening rolls. The waste removal chamber and the fiber web removal unit are arranged beneath the main roll. The arrangement provides that fibers delivered into the inner chamber are acted on by primarily a first of the opening rolls which creates a tumbling action in which contaminants comprising trash, broken fibers and dust are dislodged and deposited onto said containment receiving area while fibers picked up by a second of the opening rolls are doffed onto the main roll forming a fiber web for delivery to the fiber web removal section.

The doffing roll, the opening rolls and the main roll may be controlled to rotate in a common first direction. Alternatively, the opening rolls may be controlled to operate in a different direction from the main roll.

A triangular shaped divider is located adjacent the peripheral surface of the opening rolls and the main roll creating passageways between the divider and each surface of the first and second opening rolls. The divider is adjustably positioned so that the size of the opening may be adjusted to control the airflow through the passageways to the desired volumes.

The opening rolls and the main roll are horizontally arranged with the opening rolls being adjacent each other and the main roll located beneath and between the opening rolls.

The inner chamber includes a first wall forming a channel about the upper outer periphery of the second opening roll, and a second wall forming a channel along the lower periphery of the second opening roll and the upper outer periphery of the main roll. An opening between opposed ends the first and second walls forms a duct for waste removal from fibers picked up and carried by the second opening roll along the channel. A mote knife is arranged in the opening adjacent the second wall. The mote knife acts to assist in the removal of broken fibers and trash into the duct and away from the fibers engaged with the opening roll and moving toward the main roll. The mote knife also assists with fiber opening.

The inner chamber is formed in sections. A first section or quadrant capable of carrying the doffing roll and an opening roll, is removably attached with the housing. This section when removed allows access into the chamber, the doffing roll, the opening rolls and the main roll.

The inner chamber includes a wall extending adjacent an outer upper periphery of the main roll and about an outer periphery of the first opening roll. This wall forms a channel between itself and the roll peripheries. An air doffer is arranged adjacent the lower end of this wall forming a fiber removal section.

The waste removal section is arranged beneath the main roll and includes an opening in which a plurality of mote knives is provided. The mote knives act to dislodge waste, loose or broken fibers and dust from the fiber web and also helps in opening unopened fibers.

The opening machine includes a feed station having a pre-opening section with a fiber receiving station arranged beneath the feed station. The receiving station includes a chamber which includes a pair of substantially parallel and horizontally disposed opening rolls, and a waste receiving area. A main roll is located beneath and between the opening rolls.

A first wall forms a channel about the outer peripheries of a first opening roll and the main roll. Second and third walls form a channel about the outer peripheries of the second opening roll and the main roll. There are provided first and second waste removal openings, each of which contains at least one mote knife. In operation, the opening rolls engage the incoming fibers, creating a tumbling action, which dislodges contaminants which include trash, broken fibers, dust, etc., to the containment receiving area. Fibers picked up by a first opening roll are doffed onto the second opening roll and carried past the first waste removal opening, where further opening occurs as trash and broken fibers are removed. The fibers engaged with the opening roll are carried into position to be doffed onto the main roll where they are then carried past the second waste removal opening. Here trash and broken fibers are again removed and the fibers are further opened. The fibers are then doffed from the main roll and removed from the opening machine for further processing.

An opener for opening and cleaning fibers which includes a cabinet having a feed opening, an inner chamber, a waste removal chamber and a fiber web removal unit. A fiber feed is arranged above the opening for feeding fibers by gravity into the chamber. A pair of horizontal opening rolls are arranged parallel and adjacent each other in the lower area of the chamber. A main roll is located beneath, parallel, and between the various opening rolls. A plurality of channels is formed between the rolls and the walls of the cabinet. Openings formed in certain of these walls form the channel, which provide access to the waste removal areas. Each of these openings has a mote knife mounted therein.

A fiber removal channel or area is located beneath the main roll. Fibers fed into the channel on the main roll are removed into the fiber removal unit and removed for processing.

The cabinet includes a removable quadrant, which may carry an opening roll and a doffing roll. The quadrant along with one of an opening roll and the main roll form a first channel.

The opening rolls and the main roll may be covered with wire angled in the same direction. Alternatively, the wire on at least certain of the rolls may be angled in a direction opposite that of the adjacent roll.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
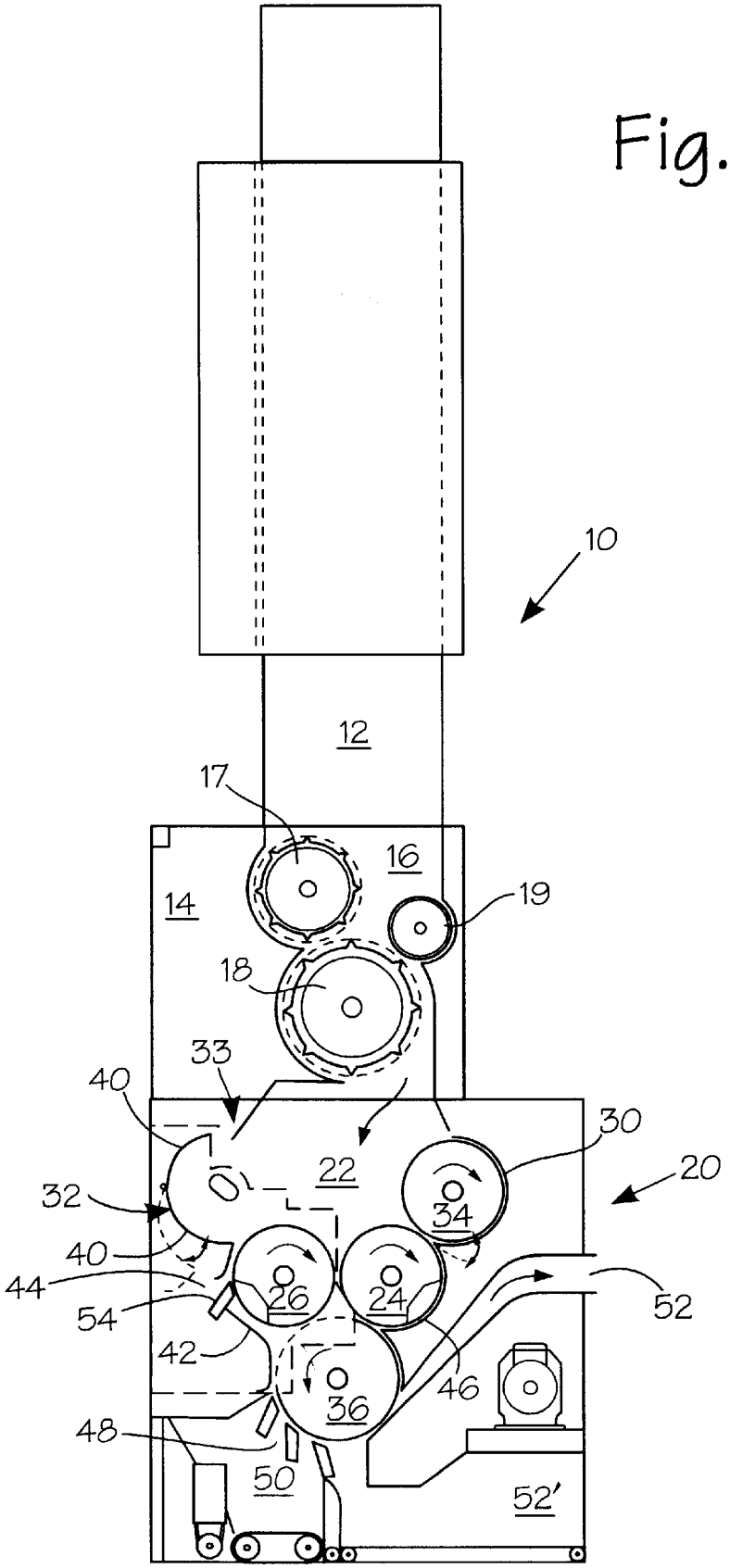
FIG. 1 is a cutaway side view of the opening and cleaning machine showing the doffing roll and both opening rolls rotating to the right and the main roll rotating to the left.

Turning to the drawings, FIG. 1 shows a first arrangement of the opening and cleaning machine of the invention. The arrangement includes fiber feed 10 which consists of a vertically disposed fiber feed chute 12 which is located over and operates to deposit fibers into feed chamber 16 of feed housing 14. Housing 14 is arranged over the feed opening of cabinet 20. Feed chamber 16 comprises a pair of feed rolls 17, 19 arranged to engage and partially open the fibers from chute 12. From chamber 16 the fibers are passed on to beater roll 18 which delivers them into chamber 22. Rolls 17, 18 and 19 act also to open and blend the fibers.

Opening chamber 22 is formed in opener cabinet 20 below beater roll 18. Opening chamber 22 includes a pair of opening rolls 24, 26 which are mounted on opposite sides of chamber 22 along parallel and horizontal axes and in adjacent positions.

Figure 3:
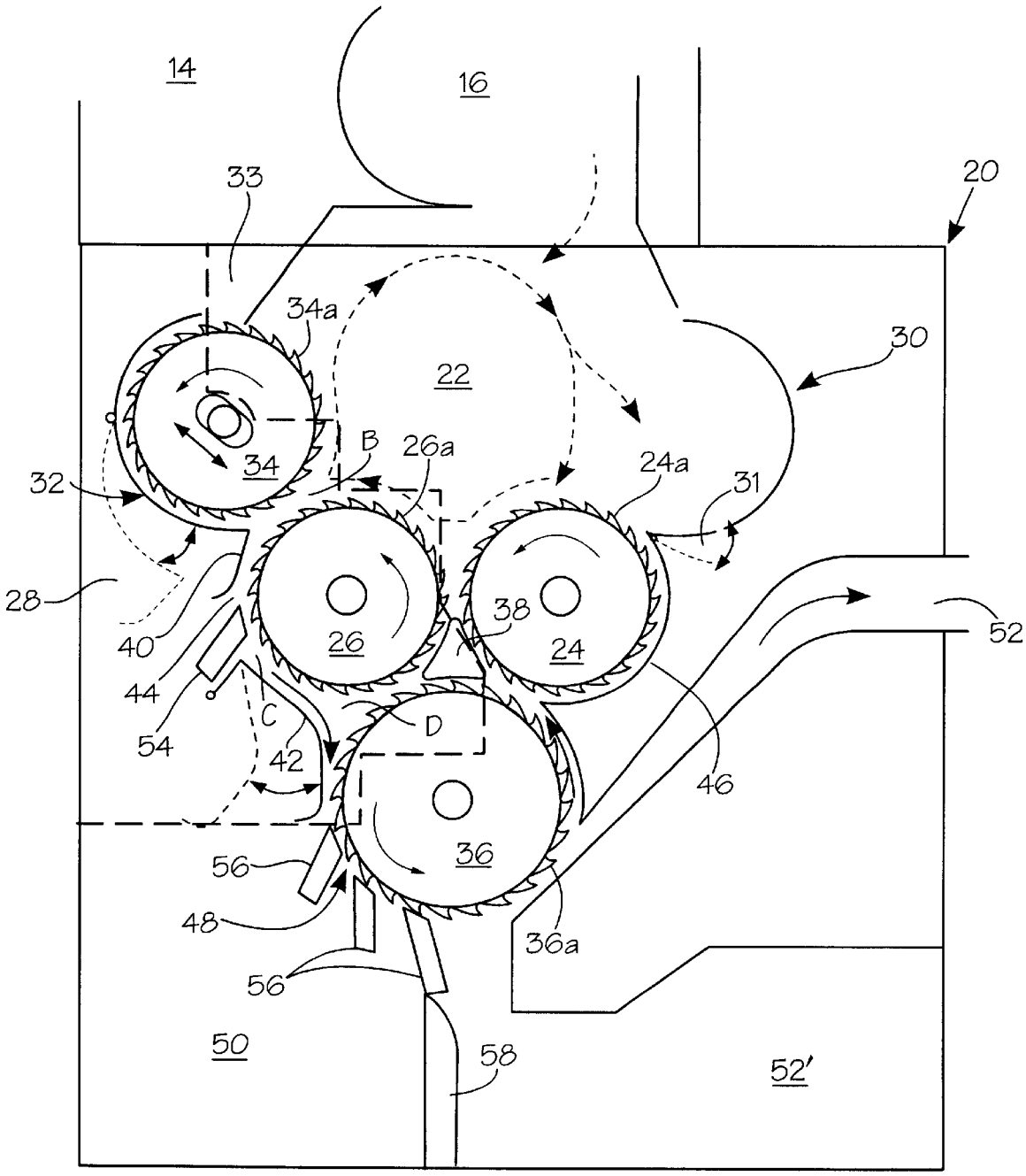
FIG. 3 is a cutaway sectional side view of the cabinet showing all rolls rotating to the left.

Chamber 22, as best seen in FIG. 3, is formed with a pair of arcuate contaminant receiving areas 30, 32 each of which includes a contaminant removal area 31, 33. A doffing roll 34 with peripheral teeth 34' is selectively mounted in either of the receiving areas 30, 32. In FIG. 1, doffer roll 34 is mounted in contaminant receiving area 30 while area 32 is unobstructed and is operative to collect trash and broken fibers removed from the fibers being fed into opening chamber 22. A pair of opening rolls 24, 26 are arranged below and slightly inward of contaminant receiving areas 30, 32. Opening rolls 24, 26 are mount in horizontal and adjacent positions which are substantially parallel. Beneath and between opening rolls 24, 26 main roll 36 is provided. Main roll 36 is horizontally arranged in position adjacent rolls 24, 26. Main roll 36 is of slightly larger diameter and operates at slightly greater RPM's than the opening and doffer rolls. The relative speeds between the main roll and the opening rolls may be adjusted as desired depending upon the type or grade of the fibers being opened and the quality of opening desired.

Divider 38, as best seen in FIG. 3, is adjustably secured to opposite sides of cabinet 20 in position adjacent and between rolls 24, 26 and 36. Divider 38 is generally triangular in shape with each side being slightly concave so as to generally conform with a peripheral surface of rolls 24, 26, and 36. By adjusting the position of divider 38 relative to rolls 24, 26 and 36 the size of the channels formed between the divider and the respective roll can be controlled. This is desirable so that the volume of rotational airflow carried in the channel between the divider and the respective roll can be controlled. It is generally desirable to limit the air flow between divider 38 and both opening rolls 24, 26 while a greater volume of air flow is desired between the divider and main roll 36.

Inner chamber 22 includes a first wall 40 forming the outer limits of receiving area 32 which extends about the outer periphery of doffing roll 34 and downwardly and about the upper outer periphery of opening roll 26. A second wall. 42 is slightly spaced from the lower end of wall 40 and extends about the outer lower periphery of opening roll 26 and the upper outer periphery of main roll 36.

A third wall 46 is provided on the opposite side of chamber 22. Wall 46 is located to extend about the upper outer periphery of main roll 36, the outer periphery of opening roll 24 and for the outer periphery of receiving area 30.

Between lower ends of walls 42 and 46 is formed the main trash removal duct or opening 48 which opens into the trash collecting and removal area 50. Trash or waste removal equipment of usual type may be provided in area 50.

Fiber removal duct 52 is arranged adjacent the lower end of wall 46 and acts to remove the opened fibers from the opening machine for further processing. An air current in the direction of the arrow doffs the fiber web off of roll 36 and into duct 52.

First duct or opening 44, opens into contaminant receiving area 50. A first mote knife 54 is positioned adjacent the upper end of wall 42 and extends into opening 44. Main duct or opening 48, which is located between the lower ends of walls 42, 46 is provided with a plurality of mote knives 56 each extending into the opening. The mote knives act to engage loose and broken fibers along with the fiber web carried by rolls 26 or 36 and assist in the opening process along with the removal of contaminants from the web through the openings 44, 48. Contaminants include trash, short or broken fibers and dust.

It is noted that sections of walls 40, 42 may be removeably or pivotally attached to cabinet 20. This arrangement is best illustrated in FIG. 3 where walls 40, 42 are shown pivoted at one end. This allows access to the rolls 26, 36 and channels B and C for cleaning or repair.

Figure 2:
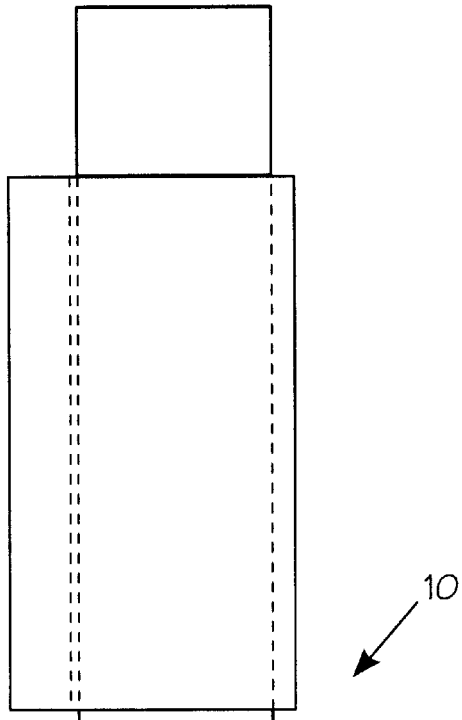
FIG. 2 is a cutaway side view of the opening and cleaning machine showing the quadrant carrying a doffing roll and an opening roll. In this arrangement all rolls rotate to the left.
Figure 2A:
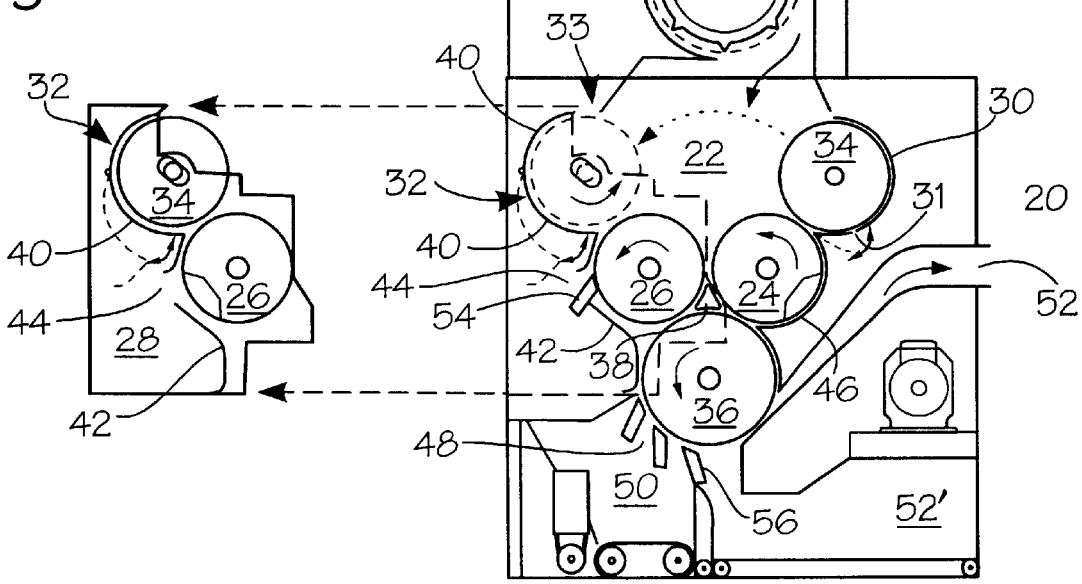
FIG. 2A is a sectional view showing the quadrant separated from the cabinet.

In another arrangement as shown in FIG. 2, cabinet 20 is formed with a removable quadrant 28 which when detached, as shown in FIG. 2*a*, removes opening roll 26 and receiving area 32, exposing chamber 22 and the remaining rolls. In this condition the doffer roll 34 may be selectively positioned between areas 30, 32 the rotational direction of rolls 24, 26 and 34 may be reversed and/or the wire direction can be re-arranged.

Turning again to FIG. 3, the fibers to be cleaned, blended and opened are fed by gravity from chute 12 into chamber 22 where a majority contact first opening roll 24. Roll 24 engages certain fibers with teeth 24*a*, causing certain ones to bounce into a circulating path as depicted, while others are gripped by the teeth. Teeth 26*a* of roll 26 engage and doff the fibers carried by roll 24 onto roll 26 and carry them in a counterclockwise direction between rolls 34, 26 into channel B. Doffing roll 34 engages fibers carried by roll 26, dislodging certain ones into the orbital path shown to be picked up later by roll 26. The fibers better engaged with teeth 26*a* move through channel B past opening or duct 44. The loose, short or broken fibers are disengaged from the web along with trash by centrifugal force and mote knife 54 and exit through opening 44 while the fibers retained on teeth 26*a* are further opened.

The fibers are now carried into channel C formed between wall 42 and rolls 26, 36. As the fibers near main roll 36, which doffs them from roll 26, the centrifugal forces along with the rotational air currents tend to dislodge certain fibers from teeth 26*a* creating a tumbling action in area D. This action further loosens impediments in the fibers and further opens and blends the fibers. All fibers are eventually picked up by teeth 36*a* of roll 36 and carried past main duct 48. As the fibers move past duct 48 a plurality of mote knives 56 engage the fibers forming a web carried on roll 36 again dislodging trash, broken fibers, and other impediments while further blending the fibers. The dislodged contaminants fall into collecting area 50 and are eventually removed by any usual means.

Roll 36 carries the remaining web of opened and cleaned fibers to removal duct 52 where they are doffed by air moving in the direction of the arrow through the duct and removed for further processing. It is noted that other systems, such as a doffer roll, could be used to remove the processed fibers from roll 36 and into the removal duct.

If desired a separator or wall 58 may be provided beneath roll 36 separating collecting area from the area 52'. This would insure that no collected contaminants are drawn from area 50 through channel 52 along with the opened and cleaned fibers.

In the arrangement described, all roll wires are angled in the opposite direction when they pass an adjacent roll, which provides for an intense fiber opening.

Should a less intensive or normal fiber opening be desired, the wire directions and direction of rotation between the main roll and the opening rolls are arranged in same directions as shown in FIG. 1.

It is to be understood that the instant arrangement could be incorporated into carding operations in the formation yarns and non-wovens.

While preferred arrangements of the invention has been described using specific terms, such description is for illustrative purposes only, and it is to be understood that changes and variations may be made without departing from the spirit or scope of the following claims.

What is claimed is:

1. An opener for opening fibers comprising:

a feed section;

an opening station located beneath said feed section and including a cabinet having an inner chamber, a waste removal chamber and a fiber web removal unit;

said inner chamber having on one side a doffing roll and on a second side a contaminant area, each arranged above one of first and second horizontally spaced opening rolls and a main roll located beneath said opening rolls;

said waste removal chamber and said fiber web removal unit being arranged beneath said main roll and said first and second opening rolls; wherein, fibers delivered into said inner chamber are acted on by primarily a first of said opening rolls creating a tumbling action in which contaminants are dislodged and deposited into said contaminant area while fibers picked up by a second of said opening rolls are doffed onto said main roll forming a fiber web for delivery to said fiber web removal section.

2. The opener of claim 1 wherein said doffing roll, said opening rolls and said main roll rotate in a common first direction.

3. The opener of claim 1 wherein a triangular shaped divider is located adjacent the peripheral surface of said opening rolls and said main roll creating passageways between said divider and each said surface of said first and second opening rolls and said main roll.

4. The opener of claim 3 wherein said divider is adjustable allowing selected adjustment of size of said passageways between said main roll, said first opening roll and said second opening roll.

5. The opener of claim 1 wherein said inner chamber includes a first wall forming a channel about the upper outer periphery of said second opening roll, a second wall forming a channel along the lower periphery of said second opening roll and the upper outer periphery of said main roll, an opening between said first and second walls forming a duct for removal of waste dislodged from fibers carried by said second opening roll along said channel and a mote knife arranged in said opening and adjacent said second wall for assisting removing broken fibers and trash into said duct.

6. The opener of claim 1 wherein said inner chamber is formed to include at least one section, carrying said doffing roll and said second opening roll, said one section being removably attached with said housing; wherein, said one section may be removed allowing access to said doffing roll, said opening rolls and said main roll.

7. The opener of claim 1 wherein said first and second opening rolls are rotating in a common first direction and said main roll is rotating in a second direction.

8. The opener of claim 1 wherein said inner chamber includes a third wall extending adjacent an outer upper periphery of said main roll and about an outer periphery of said first opening roll, said third wall forming a channel between said roll peripheries; and, a doffer adjacent a lower end of said wall forming said fiber removal unit.

9. The opener of claim 1 wherein said waste removal section is arranged beneath said main roll and includes an opening between said fiber removal chamber and said second wall in which a plurality of mote knives are positioned to dislodge waste and loose or broken fibers from the fiber web and to help open unopened fibers.

10. The opener of claim 1 wherein said opening rolls are arranged horizontally and substantially parallel of each other.

11. An opener for opening fibers comprising:

a feed station including a pre-opening section;

a fiber receiving station arranged beneath said feed station and including a pair of substantially parallel and horizontally disposed opening rolls, a blending chamber and a containment receiving area;

a main roll located beneath and between said first and second opening rolls;

a first wall forming a channel about outer peripheries of said first opening roll and said main roll;

second and third walls forming a channel about outer peripheries of said second opening roll and said main roll; and first and second waste removal openings each containing at least one mote knife arranged between said second and third walls adjacent said second opening roll and between said first and third walls adjacent said main roll; wherein fibers fed into said receiving station are contacted by said first and second opening rolls creating a tumbling action which dislodges contaminant comprising trash, broken fibers and dust from said fibers into said waste receiving area, fibers picked up by said first opening roll are doffed onto said second opening roll and carried past said first waste removal opening, where contaminants are removed, and further opening occurs, and into position to be doffed onto said main roll, said fibers are then carried past said second waste removal opening where further opening occurs as contaminants are again removed;

said fibers-are then doffed from said main roll.

12. An opener for opening fibers comprising:

a cabinet having a feed opening, an inner chamber, a waste removal chamber and a fiber web removal unit;

a fiber feed arranged above said opening for feeding fibers by gravity into said inner chamber;

a pair of horizontally spaced opening rolls arranged parallel and adjacent each other, said opening rolls being located in the lower area of said inner chamber;

a main roll located beneath, parallel, and between said opening rolls;

a plurality of channels formed between said rolls and walls of said cabinet;

openings formed in certain of said walls forming said channels providing access to said waste removal areas, each said opening having a mote knife mounted therein; and, a fiber removal unit located beneath said main roll; wherein, fibers fed into said inner chamber after being engaged, tumbled and opened are carried by an opening roll through a first channel to be doffed onto said main roll, said main roll carrying said fibers to said fiber removal unit where said fibers are removed for further processing.

13. The opener of claim 12 wherein said cabinet includes a removable quadrant which carries one of said opening rolls.

14. The opener of claim 13 wherein said quadrant along with one of said opening rolls and said main roll forms said first channel.

15. The opener of claim 12 including a divider located in the channels formed between the main roll and the opening rolls, said divider being adjustably positioned relative to said rolls for selectively controlling channel size.

16. The opener of claim 12 wherein each said opening roll and said main roll are covered with wire angled in the same direction.

17. The opener of claim 12 wherein each said opening roll and said main roll are covered with wire, on at least certain of said rolls said wire is angled in a direction opposite that of an adjacent roll.

18. An opener for opening fibers comprising:

a cabinet having a feed opening, an inner chamber, and a fiber web removal unit;

a fiber feed arranged above said opening for feeding fibers by gravity into said inner chamber;

a pair of horizontally spaced opening rolls arranged parallel and adjacent each other, said opening rolls being located in the lower area of said inner chamber;

a main roll located beneath, parallel, and between said opening rolls;

a plurality of channels formed between said rolls and walls of said cabinet;

openings formed in certain of said walls, each said opening having a mote knife mounted therein; and, a fiber removal unit located beneath said main roll; wherein fibers fed into said inner chamber after being engaged, tumbled and opened are carried by an opening roll through a first channel to be doffed onto said main roll, said main roll carrying said fibers to said fiber removal unit where said fibers are removed for further processing.

* * * * *